United States Patent [19]

Radcliffe

[11] Patent Number: 4,993,154

[45] Date of Patent: Feb. 19, 1991

[54] SHAVING APPARATUS

[76] Inventor: Allan Radcliffe, 12459 Floresta Ct., San Diego, Calif. 92128

[21] Appl. No.: 486,810

[22] Filed: Mar. 1, 1990

[51] Int. Cl.[5] ..... B26B 21/14; B26B 21/52; B26B 21/00; B26B 21/16

[52] U.S. Cl. ..... 30/85; 30/32; 30/49; 30/89

[58] Field of Search ..... 30/34.05, 47, 48, 49, 30/85, 87, 88, 89, 32

[56] References Cited

U.S. PATENT DOCUMENTS

| | | | |
|---|---|---|---|
| 1,798,447 | 3/1931 | Behrman | 30/49 |
| 1,966,307 | 7/1934 | Ohmer | 30/49 |
| 3,407,496 | 10/1968 | Pomper | 30/49 |
| 3,600,804 | 8/1971 | Brown | 30/32 |
| 4,208,791 | 6/1980 | Van Cleve | 30/49 |
| 4,454,744 | 7/1984 | Esnard | 30/49 |
| 4,599,793 | 7/1986 | Iten | 30/85 |
| 4,693,003 | 9/1987 | Ferraro | 30/89 |
| 4,791,724 | 12/1988 | Dumas | 30/89 |

FOREIGN PATENT DOCUMENTS

| | | | |
|---|---|---|---|
| 2172236 | 8/1986 | United Kingdom | 30/89 |

*Primary Examiner*—Douglas D. Watts
*Assistant Examiner*—Paul M. Heyrana, Sr.
*Attorney, Agent, or Firm*—Andsel Group, Inc.

[57] ABSTRACT

A shaving apparatus is described that has a handle, a bifurcated expansion means with one end connected to the handle and with another end attached to a razor head containing at least one blade and at least one spacer that are retained in a base in such a manner so as to allow the blades and spacers to move longitudinally as the base, blades and spacers are moved from a convex curve through a straight configuration to a concave curve to accommodate the various surfaces requiring shaving on the body. There is an adjustment means on the apparatus that allows the user to select the curvature of the blade desired without visually referencing the apparatus. There is a contraction means to enhance the movement of the blades from the expanded position of the concave configuration to the retracted position of the convex configuration.

9 Claims, 1 Drawing Sheet

SHAVING APPARATUS

BACKGROUND OF THE INVENTION

1. Field of the Invention

This invention, in general, relates to an apparatus for shaving and, in particular, to a disposable safety razor that may be adjusted to provide a convex, straight and a concave shaving edge to accommodate the various configurations of body contours encountered during shaving.

2. Description of the Related Art

Since the introduction of the conventional safety razor, the shaving device has consisted mostly of a handle, a base with a guard and a cover that opens to admit and retain a flexible blade. With the advent of the disposable razor, the blade was placed in a fixed base and the entire razor assembly was disposed of when the blade became dull.

Most disposable safety razors provide two or more, spaced apart, parallel, straight, single-edged blades. In the past, conventional razors have introduced the ability to change the curvature of the flexible blade to either convex or concave. Some of these razors required the user to remove and turn the base over to provide a convex or concave shaving surface and some designed to change shape as they were drawn over the surface being shaved. None of these provided a razor that would conform to the facial or body contours easily and allow the user to quickly change the contour of the blade when needed as does the present invention.

U.S. Pat. No. 1,798,447 to M. B. Behrman on Mar. 31, 1931 shows a razor with a convex movable head that forces a flat blade into a convex shape. The blade remains in the convex shape while secured in the razor head.

U.S. Pat. No. 3,407,496 to W. R. Pomper on Oct. 29, 1968 describes a razor that forms the blade into various convex shapes. The user has no control over this razor except by how hard he or she presses down on the razor.

U.S. Pat. No. 4,208,791 to Barbara J. Van Cleve on June 24, 1980 shows a razor with a nonadjustable head into which can be inserted two flat blades, one on a convex-shaped side and the other on a concave-shaped side. This razor is not easily used on the variety of shaved areas of the body.

U.S. Pat. No. 4,459,744 to Miguel H. Esnard on July 17, 1984 describes a razor that bends a blade from convex to concave as it is drawn over the selected shaving surface. Again, only friction controls the flexing of this blade and would be difficult to master without cutting or abrading the surface being shaved.

SUMMARY OF THE INVENTION

The present invention overcomes the above disadvantages by providing a user-controlled adjustable razor head and blade shape to give the user a shaving apparatus that can be utilized to shave the various convex, straight and concave contours of the body. The user has an intimate knowledge of the surface requiring shaving and the present invention allows the user to select the blade shape that will accomplish the task in an efficient manner.

In operation, the head containing the blade in the razor of the present invention is at rest in the convex position. The adjustment slide in the slide channel, located in the handle, is at a point most distant from the razor head when the blade is in the convex position. As the slide is moved toward the head, the blade and the head radius become greater until the blade and the head no longer have a convex curvature and assume a straight configuration at approximately a central point of the slide channel. When the adjustment slide passes beyond the point where the head and blade are straight and the slide nears the end of the channel nearest the head, the head and the blade begin to assume a concave shape. Detents are provided in the channel to aid the user in selecting a desired shape of the head and blade without visually determining the location of the adjustment slide in the channel. The end of the passageway keeps the adjustment slide from exiting the channel and the passageway.

A shaving apparatus described herein has a handle, a bifurcated expansion means with one end attached to the handle and an other end attached to a razor head to provide a tensional force that changes a curvature of the razor head, and an adjustment means in the bifurcated expansion means to expand the bifurcated expansion means.

The bifurcated expansion means may have a passageway formed between a first arm and a second arm of the bifurcated expansion means, and a first channel and a second channel formed between the edges of the first arm and the second arm of the bifurcated expansion means.

The razor head may have a base, at least one razor blade on the base, at least one spacer on the base, a plurality of elongated retainer ports in the base, in the blades and in the spacers, and a plurality of retainer means in the elongated retainer ports to retain the blades and the spacers in a sliding relationship with the base to allow the blades and the spacers longitudinal movement when the curvature of the base, the blades and the spacers is changed.

The adjustment means may have a rod within the passageway to expand the bifurcated expansion means, and a first pad and a second pad in a plane parallel to and extending slightly outside of an outer surface of the bifurcated extension means. The adjustment means also has the first pad connected to one end of a first tab and the second pad being connected to one end of a second tab, and the first tab and the second tab being slidingly placed in the first channel and the second channel, respectively. An other end of the first tab and an other end of the second tab being connected to the rod, and the first tab and the second tab guide the first pad and the second pad parallel to the first channel and the second channel, respectively.

There may be a textured surface on the first pad and on the second pad. The first channel and the second channel may have a plurality of detents at a plurality of preselected parallel points in the first channel and in the second channel to releasingly engage at least one detent knob on at least one side of the first tab and the second tab. There may be a contraction means on the bifurcated expansion means to move the first and the second arms from an expanded position to a contracted position. In an alternative embodiment, the contraction means will not be present. The base of the shaving apparatus will be at rest in the convex configuration in the alternative embodiment and the preferred embodiment.

There could be other configurations of the adjustment means to adjust the bifurcated expansion means. Such configuration could include a thumb wheel driving a screwjack means to expand and contract the arms of the bifurcated expansion means. Another configuration is a vertical wedge which when slid along the channels to cause expansion and contraction. Yet another configuration is a rotating elliptical cam means, either smooth or stepped which when rotated expands and contracts the arms. Another example would be a rotating wedge thumb wheel. Yet another would be a lever operated cam that would adjust the separation of the arms of the bifurcated expansion means as it was moved from side-to-side.

The inherent forces present from the curved base upon the first and the second arms will contract the arms back to a contracted position from an expanded position. The contraction means of the preferred embodiment enhances the contraction forces inherent in the construction of the alternative embodiment and the preferred embodiment.

It is therefore an object of this invention to provide a shaving apparatus that allows the user to select several configurations of blade curvatures including: straight, convex and concave; to shave a wide variety of body surfaces requiring shaving.

It is another object of this invention to provide a shaving apparatus that is disposable and easy to use.

It is yet another object of this invention to provide a shaving apparatus with an adjustment that has a series of detents that allows the user to adjust the curvature of the blades without having to visually reference the location of the adjustment means.

DESCRIPTION OF THE PREFERRED EMBODIMENT

Figure 1:
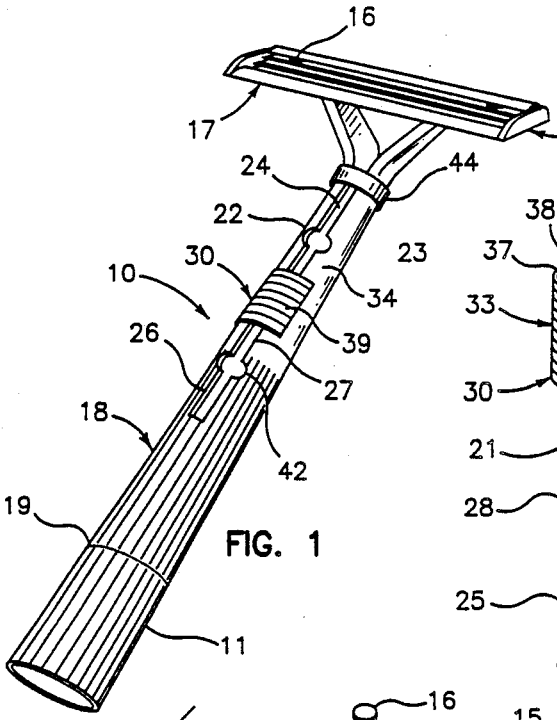
FIG. 1 is a perspective view of the preferred embodiment of the shaving apparatus or razor that has a contraction means on the bifurcated expansion means at the uppermost end of the channel.
Figure 2:
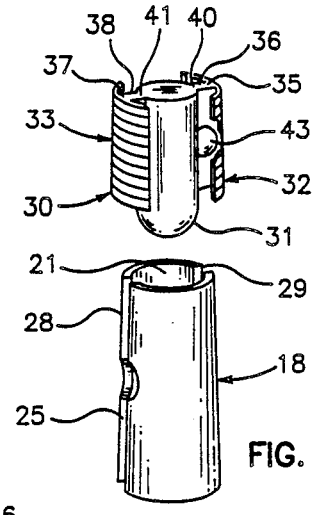
FIG. 2 is a partial view of the bifurcated expansion means of the shaving apparatus showing the adjustment slide.
Figure 8:
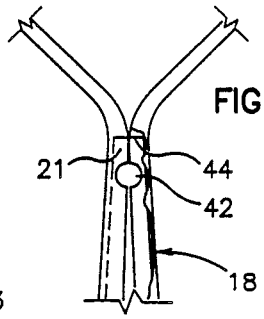
FIG. 8 shows a partial view of the bifurcated expansion means showing an end of the chamber against which the rod of the adjustment means abuts.
Figure 4:
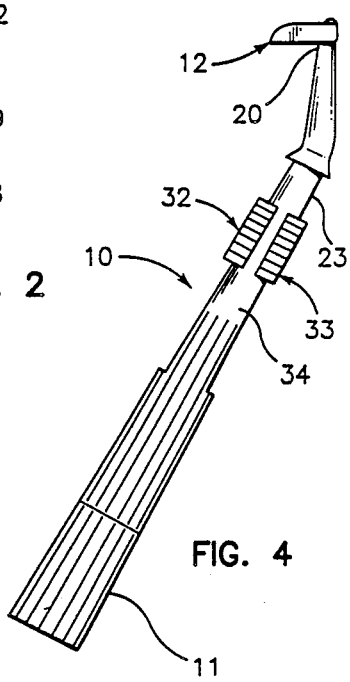
FIG. 4 is a side view of the razor shown in FIG. 1 showing an alternative adjustment slide stopping means.
Figure 5:
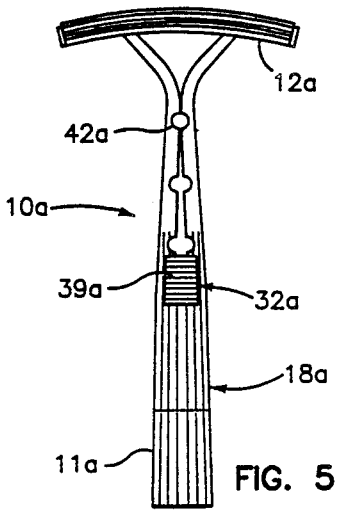
FIG. 5 is a front view of an alternative embodiment of the shaving apparatus without the contraction means showing the razor head in the convex configuration.
Figure 6:
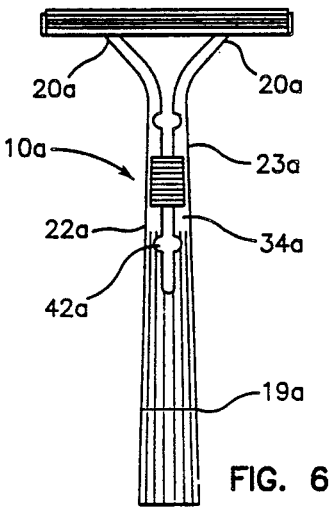
FIG. 6 is shows a front view of the razor head of the shaving apparatus in the straight configuration.
Figure 7:
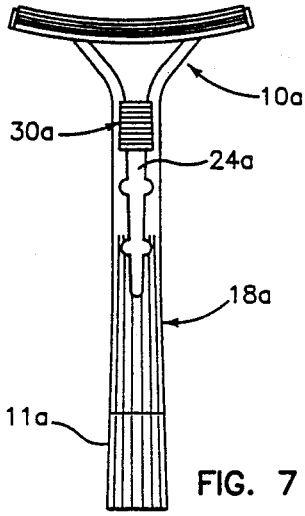
FIG. 7 shows a front view of the razor head in the concave configuration.

Referring to FIGS. 1,2,3,4,5,6,7 and 8, the preferred embodiment 10 and the alternative embodiment 10*a* are shown. The preferred embodiment shown in FIGS. 1 and 4 have the same razor head curve configurations as shown in FIGS. 5, 6 and 7. All parts of both embodiments shall have identical reference numbers with the exception of a letter "a" following the numbers of the alternative embodiment. Both embodiments function in the same manner except that the alternative embodiment 10*a* does not have a contraction ring.

Figure 3:
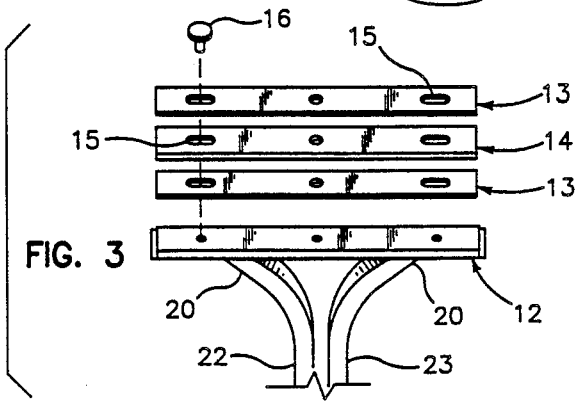
FIG. 3 is a partial view of the razor showing an exploded view of the razor head with the base, the blades and the spacers.

A shaving apparatus 10 has a handle 11, a base 12, at least one razor blade 13 on the base 12, and at least one spacer 14 on the base 12. There may be more that one blade 13 and, if so, there may be more than one spacer 14. The spacers 14 and the blades 13 will be placed on the base 12 alternately. There are a plurality of elongated retainer ports 15 in the base 12, in the blades 13 and in the spacers 14. There are a plurality of retainer means 16 in the elongated retainer ports 15 to retain the blades 13 and the spacers 14 in a sliding relationship with the base 12 to allow the blades 13 and the spacers 14 longitudinal movement when a curvature of the razor head 17 (see FIGS. 5, 6 and 7.) is changed. FIG. 3 shows the elongated retainer ports 15 and the retainers 16. The retainers 16 are secured to the base 12 snugly enough to allow very little vertical movement yet still allow enough longitudinal movement to allow the blades 13 and spacers 14 to arch into the desired shaving curve.

There is a bifurcated expansion means 18 with one end 19 attached to the handle 11 and an other end 20 attached to the base 12 to provide a tensional force that changes the curvature of the base 12, the blades 13 and the spacers 14. A passageway 21 is formed between a first arm 22 and a second arm 23 of the bifurcated expansion means 18. There is a first channel 24 and a second channel 25 formed between the edges 26 and 27 of the first arm 22 and the edges 28 and 29 of the second arm 23 of the bifurcated expansion means 18. As part of the adjustment means 30, there is a rod 31 (shown in FIG. 2) within the passageway 21 to expand the bifurcated expansion means 18 as shown in FIGS. 6 and 7.

Another part of the adjustment means 30 is a first pad 32 and a second pad 33 in a plane parallel to and extending slightly outside of an outer surface 34 of the bifurcated extension means 18. The first pad 32 being connected to one end 35 of a first tab 36 and the second pad 33 being connected to one end 37 of a second tab 38. There is a textured surface 39 on the first pad 32 and on the second pad 33. The first tab 36 and the second tab 38 are slidingly placed in the first channel 24 and the second channel 25, respectively. An other end 40 of the first tab 36 and an other end 41 of the second tab 38 are connected to the rod 31. The first tab 36 and the second tab 38 guide the first pad 32 and the second pad 33 parallel to the first channel 24 and the second channel 25, respectively. There are a plurality of detents 42 at a plurality of preselected parallel points in the first channel 24 and in the second channel 25 to releasingly retain the first tab 36 and the second tab 38. There are detent knobs 43 on both sides of tab 36 and on both sides of tab 38 that releasingly engage the detents 42. There may be a contraction means 44 on the bifurcated means 18 to move the first arm 22 and the second arm 23 from an extended position shown in FIG. 7 to a contracted position shown in FIG. 1. There is an end wall 44 at an end of the passageway 21 that the adjustment means 30 strikes to keep the adjustment means 30 from exiting the passageway 21 and the channels 23 and 25. FIG. 4 shows an alternative to the end wall 44. A boss or raised portion could be placed on the bifurcated extension means.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A shaving apparatus comprising:

a. a handle;

b. a bifurcated expansion means with one end attached to the handle and an other end attached to a razor head to provide a tensional force that changes a curvature of the razor head; and c. an adjustment means in the bifurcated expansion means to expand the bifurcated expansion means.

2. A shaving apparatus as described in claim 1 wherein the bifurcated expansion means further comprises:

a. a passageway formed between a first arm and a second arm of the bifurcated expansion means; and b. a first channel and a second channel formed between the edges of the first arm and the second arm of the bifurcated expansion means.

3. A shaving apparatus as described in claim 1 wherein the razor head further comprises:

a. a base;

b. at least one razor blade on the base;

c. at least one spacer on the base;

d. a plurality of elongated retainer ports in the base, in the blades and in the spacers; and e. a plurality of retainer means in the elongated retainer ports to retain the blades and the spacers in a sliding relationship with the base to allow the blades and the spacers longitudinal movement when the curvature of the base, the blades and the spacers is changed.

4. A shaving apparatus comprising:

a. a handle;

b. a base;

c. at least one razor blade on the base;

d. at least one spacer on the base;

e. a plurality of elongated retainer ports in the base, in the blades and in the spacers; and f. a plurality of retainer means in the elongated retainer ports to retain the blades and the spacers in a sliding relationship with the base to allow the blades and the spacers longitudinal movement when the curvature of the base, the blades and the spacers is changed;

g. a bifurcated expansion means with one end attached to the handle and an other end attached to the base to provide a tensional force that changes a curvature of the base, the blades and the spacers;

h. a passageway formed between a first arm and a second arm of the bifurcated expansion means;

i. a first channel and a second channel formed between the edges of the first arm and the second arm of the bifurcated expansion means; and j. an adjustment means in the bifurcated expansion means to expand the bifurcated expansion means.

5. A shaving apparatus as described in claim 4 wherein the adjustment means further comprises:

a. a rod within the passageway to expand the bifurcated expansion means;

b. a first pad and second pad in a plane parallel to and extending slightly outside of an outer surface of the bifurcated extension means;

c. the first pad being connected to one end of a first tab and the second pad being connected to one end of a second tab;

d. the first tab and the second tab being slidingly placed in the first channel and the second channel, respectively;

e. an other end of the first tab and an other end of the second tab being connected to the rod; and f. the first tab and the second tab guiding the first pad and the second pad parallel to the first channel and the second channel, respectively.

6. A shaving apparatus as described in claim 5 further comprising a textured surface on the first pad and the second pad.

7. A shaving apparatus as described in claim 4 wherein the first channel and the second channel further comprise a plurality of detents at a plurality of preselected parallel points on the first channel and on the second channel to releasingly engage at least one detent knob on at least one side of the first tab and the second tab.

8. A shaving apparatus comprising:

a. a handle;

b. a base;

c. at least one razor blade on the base;

d. at least one spacer on the base;

e. a plurality of elongated retainer ports in the base, in the blades and in the spacers;

f. a plurality of retainer means in the elongated retainer ports to retain the blades and the spacers in a sliding relationship with the base to allow the blades and the spacers longitudinal movement when a curvature of the base, the blades and the spacers is changed;

g. a bifurcated expansion means with one end attached to the handle and an other end attached to the base to provide a tensional force that changes the curvature of the base, the blades and the spacers;

h. a passageway formed between a first arm and a second arm of the bifurcated expansion means;

i. a first channel and a second channel formed between the edges of the first arm the second arm of the bifurcated expansion means;

j. a rod within the passageway to expand the bifurcated expansion means;

k. a first pad and a second pad in a plane parallel to and extending slightly outside of an outer surface of the bifurcated extension means;

l. the first pad being connected to one end of a first tab and the second pad being connected to one end of a second tab;

m. a textured surface on the first pad and the second pad;

n. the first tab and the second tab being slidingly placed in the first channel and the second channel, respectively;

o. an other end of the first tab and an other end of the second tab being connected to the rod;

p. the first tab and the second tab guiding the first pad and the second pad parallel to the first channel and the second channel, respectively; and q. a plurality of detents at a plurality of preselected parallel points in the first channel and in the second channel to releasing engage at least one detent knob on at least one side of the first tab and the second tab.

9. A shaving apparatus as described in claim 8 further comprising a contraction means on the bifurcated expansion means to move the first and the second arms from an expanded position to a contracted position.

* * * * *